US006090768A

United States Patent [19]

Delaney et al.

[11] Patent Number: 6,090,768

[45] Date of Patent: Jul. 18, 2000

[54] GERMICIDAL LIQUID LAUNDRY DETERGENT COMPOSITIONS INCLUDING OPTICAL BRIGHTENERS

[75] Inventors: Susan Delaney, Bloomingdale; Alan Francis Richter, Branchburg, both of N.J.; Timothy John Taylor, Scottsdale, Ariz.

[73] Assignee: Reckitt & Colman Inc., Wayne, N.J.

[21] Appl. No.: 09/139,681

[22] Filed: Aug. 25, 1998

[30] Foreign Application Priority Data

Jun. 10, 1998 [GB] United Kingdom ..... 9812455

[51] Int. Cl.[7] ..... C11D 1/86; C11D 3/28

[52] U.S. Cl. ..... 510/325; 510/324; 510/350; 510/384; 510/394

[58] Field of Search ..... 510/324, 325, 510/326, 394, 384, 350

[56] References Cited

U.S. PATENT DOCUMENTS

| | | | |
|---|---|---|---|
| 4,259,217 | 3/1981 | Murphy | 252/547 |
| 4,333,862 | 6/1982 | Smith et al. | 252/547 |
| 4,347,168 | 8/1982 | Murphy et al. | 252/547 |
| 4,576,729 | 3/1986 | Paszek et al. | 252/106 |
| 4,722,802 | 2/1988 | Hutchings et al. | 252/174 |
| 4,810,409 | 3/1989 | Harrison et al. | 252/102 |
| 4,873,002 | 10/1989 | Ibrahim | 252/8.8 |
| 5,728,667 | 3/1998 | Richter | 510/235 |
| 5,728,672 | 3/1998 | Richter | 510/463 |
| 5,798,329 | 8/1998 | Taylor et al. | 510/384 |

FOREIGN PATENT DOCUMENTS

| | | | |
|---|---|---|---|
| 0 808 893 A2 | 11/1997 | European Pat. Off. | C11D 3/42 |
| 0 808 893 A3 | 11/1997 | European Pat. Off. | C11D 3/42 |
| 0 843 002 A2 | 5/1998 | European Pat. Off. | C11D 3/48 |
| 2 287 949 | 10/1995 | United Kingdom | C11D 3/12 |
| 2 309 706 | 8/1997 | United Kingdom | C11D 1/86 |
| WO97/15647 | 1/1997 | WIPO | C11D 1/62 |
| WO97/28238 | 7/1997 | WIPO | C11D 1/86 |
| 97/28238 | 8/1997 | WIPO | C11D 1/86 |

*Primary Examiner*—Yogendra Gupta
*Assistant Examiner*—Christine E. Ingersoll
*Attorney, Agent, or Firm*—Fish & Richardson P.C.

[57] ABSTRACT

Liquid laundry detergent compositions provide good detergency for the cleaning of garments and textiles, as well as further providing a germicidal action to textile fabrics in a domestic laundering process. There is provided an aqueous, germicidal liquid detergent composition comprising:

A) a major anionic surfactant constituent selected from alkylethercarboxylates and alkylethersulfonates;

B) a cationic germicidal surfactant;

C) a nonionic surfactant preferably selected from alcoholalkoxylates, akylphenol alkoxylates, alkylpolyglycosides, amine oxides and alkanolomides, wherein the value of the cationic surfactant to the major anionic surfactant is 1:2 or greater; and, D) a compatible optical brightener constituent.

Further conventional additives may be included as optional constituents.

20 Claims, No Drawings

GERMICIDAL LIQUID LAUNDRY DETERGENT COMPOSITIONS INCLUDING OPTICAL BRIGHTENERS

Liquid detergent compositions, particularly concentrated liquid detergent compositions which find particular use in laundering textiles and garments are well known to the art. Salient characteristics of such compositions include: good detergency, good anti-soil redeposition properties, minimal deleterious effect to textiles or garments washed with the same, such as color fading or decomposition of the textile or garments due to the action of one or more constituents in the detergent compositions, i.e., undesirable enzymatic effects. Liquid detergent compositions of this type, which are well known to both commercial and private consumers, include detergent compositions which are marketed for use in the laundering of garments or textiles in a washing machine. While such compositions are well known to provide good cleaning effects, it is also known that such liquid detergent compositions, presently being marketed as a laundry detergent compositions, do not generally provide a particularly effective sanitizing or disinfecting effect to the laundered garments or textiles. Such laundry detergent compositions typically fail to provide for specific protection against harmful bacteria and other microorganisms present in the garments or textiles. Accordingly, there exists a present need in the art of laundry detergent compositions for products which provide both excellent detergency and a sanitizing effect providing for a high level of protection against harmful bacteria as may normally be present in the household including gram positive and gram negative vegetative bacteria such as those belonging to the species: Salmonella, Klebsiella and Staphylococcus.

While such compositions would be desirable, these have also been difficult to readily produce as it is well known that certain particularly effective cationic surfactant germicides, including certain quaternary ammonium surfactants, are known to be effective against such gram positive and gram negative vegetative bacteria. It may also be readily seen that such germicides are not frequently found to be useful in detergent formulations. Many successful formulations comprise a significant fraction of one or more anionic surfactants, which are well known to be useful detersive agents, which however are considered incompatible with cationic surfactants, particularly quaternary ammonium surfactants. Notwithstanding such a technical problem, certain formulations comprising cationic surfactant germicides are known.

For example, U.S. Pat. No. 5,080,830 teaches a water dispersible composition comprising a hydrophobic quaternary ammonium compound, a polyether derivative compound used as a dispersing agent and certain quaternary ammonium salts which are used as a stabilizing agent for the aqueous formulations formed from these constituents.

U.S. Pat. No. 5,368,756 to Vogel et al. provides a rinse added fabric softening composition which comprises a mixture of certain diester quaternary ammonium compounds with a highly ethoxylated hydrophobic material and a liquid carrier, preferably water. The invention appears to be directed to limiting the formation of soap scum caused by the interaction of the diester quaternary ammonium compound with anionic detergent surfactants and/or detergency builders which may be entrapped in a fabric being treated.

U.S. Pat. No. 5,399,280 to Woo et al. provides certain hard surface detergent compositions comprising either a mixture of zwitterionic detergent surfactants or a low sudsing nonionic detergent surfactant with a suds reducing amount of a phosphorous containing alkoxylate which compound provides good suds regulation and maintains good spotting/filming and rinsing characteristics, and optionally, but preferably, a hydrophobic solvent which itself provides additional cleaning activity.

U.S. Pat. No. 5,409,621 to Ellis et al. teaches a fabric softening composition comprising a water insoluble quaternary ammonium compound and a nonionic stabilizing agent which may be an alkoxylated $C_8$–$C_{22}$ linear alcohol comprising on average 10 or more moles of an alkylene oxide or which may be a $C_{10}$–$C_{20}$ alcohol, or mixture thereof. These constituents are desirably provided in an aqueous carrier.

U.S. Pat. No. 5,415,813 to Misselyn et al. provides an all-purpose liquid cleaner in the form of a microemulsion which finds use in cleaning hard surfaces are said to be effective in removing grease soils. All of these compositions provide a certain class of quaternary ammonium compounds; such compounds are cited as grease release agents.

U.S. Pat. No. 4,576,729 to Paszek et al. provides stable liquid disinfectant laundry detergent compositions which comprise a nonionic surfactant, a so-called cryptoanionic surfactant and a quaternary ammonium compound which is effective as a germicidal active agent, as well as minor amounts of other nonessential ingredients. Therein is taught that a critical combination of a nonionic surfactant of an ethoxylated octyl or nonyl phenol with a cryptoanionic surfactant of the alkyl alkoxy carboxylate class and a quaternary ammonium germicide in a water carrier in particular ratios of nonionic surfactant:cryptoanionic surfactant:quaternary ammonium germicide, in the range of from 2:4:1 to 3.5:5:1 provide effective laundry detergent compositions which offer a germicidal effect and antisoil redeposition properties. The compositions are provided preferably in liquid form and may comprise other nonessential ingredients including foam stabilizers, anti-irritating agents, brighteners, fragrances, dyes, pH adjusters such as a buffer, or tri-ethanol amine and a viscosity modifier such as ethanol. Therein, it was observed that the addition of the nonionic ethoxylated octyl and nonyl phenol surfactants were an essential constituent in order to provide both stability and good detersive action. Further, as is illustrated on Table 2 of that patent, the compositions taught therein were effective to have germicidal efficacy in aqueous dilutions within the range of from 1:200 to 1:333 in parts by weight, with most of the compositions having germicidal efficacy at maximum dilutions of 1:200–250.

U.S. Pat. No. 4,810,409 to Harrison et al. teaches compositions comprising a quaternary ammonium germicide, anionic and nonionic surfactants wherein the ratio of cationic:anionic surfactant are at least 3.3:1. In such a manner, Harrison demonstrates that such an excess of cationic surfactant is needed to maintain germicidal efficacy in the presence of the claimed amount of anionic surfactant.

U.S. Pat. No. 4,493,773 to Cook et al. teaches certain low phosphate detergent compositions which include nonionic detergent surfactants, an alkyl polysaccharide detergent surfactant, and a cationic softening/anti-static compound which may be a quaternary ammonium cationic surfactant. In the aforesaid compositions, the nonionic surfactant is preferably one according to the formula $R(OC_2H_4)_nOH$ wherein R is a primary alkyl $C_{10-18}$ and n has an average value of from about 2 to 9. The alkyl polysaccharide detergent surfactant is one according to the formula $RO(R'O)_y(Z)_x$ wherein R is an alkyl hydroxalkyl alkylphenol, hydroxyalkyl phenol, alkyl benzyl or mixture of one or more of the above, wherein the alkyl groups comprise from 8 to 18 carbon atoms; where R' contains from about 2 to 4 carbon atoms, y is a value from 0 to about 12, each Z is a moiety derived from reducing saccharide containing 5 or 6 carbon atoms, and x is a number from about 1 to about 10. The quaternary ammonium cationic surfactant has two chains which contain an average from about 16 to about 22 carbon atoms.

U.S. Pat. No. 4,272,395 to Wright teaches a hard surface cleaning composition which comprises a quaternary ammonium compound as a germicidal active agent and a co-surfactant selected from the group consisting of: short chain anionic surfactants having $C_3$–$C_8$ in the hydrophobic group; low alkoxylated nonionic surfactants having 0–4 ethylene oxide and/or propylene groups in the molecule, as well as mixtures thereof. Therein it is taught that compositions comprising a conventional anionic surfactant of more than 8 carbons in the hydrophobic group or conventional nonionic detergents having more than 4 ethylene oxide groups were found to be poor performers as compared with the short chain anionic surfactants of 3 to 8 carbon atoms and/or low alkoxylated nonionic surfactants having 0 to 4 ethylene oxide or propylene groups in the molecule. The compositions of the invention according to U.S. Pat. No. 4,272,395 preferably comprise 50–95 parts by weight of the quaternary ammonium, 5–50 parts by weight of the anionic surfactant and 0–20 parts by weight of the nonionic surfactant.

U.S. Pat. No. 5,378,409 to Ofosu-Asante et al. teaches a specific light duty liquid or gel dishwashing detergent composition which comprises a surfactant mixture (I) which includes: (a) 100% by weight of certain alkyl ethoxy carboxylates according to the formula $RO(CH_2CH_2O)_x CH_2COO^-M^+$; (b) 0 to 10% by weight of alcohol ethoxylate according to the formula $RO(CH_2CH_2O)_xH$ and (c) 0 to 10% of one or more soaps according to the formula $RCOO^-M^+$, (II) from 0.1%–4% calcium ions, and (c) from 0 to about 10% of a calcium chelating agent said to prevent the formation of calcium carbonate participates in the composition, such that the said dishwashing detergent composition in a 10% by weight aqueous solution exhibits a pH of from 7–11. The specification recites that the alkyl ethoxy carboxylate within the surfactant mixture does not comprise a calcium ion, and this Patent later teaches the selected addition of certain salts in order to introduce the calcium ions in specific weight percentages to the cleaning composition. The presence of the calcium ions are cited at providing good grease removal, storage stability, and skin mildness. The specification also recites the use of limited amounts of certain cationic quaternary ammonium compounds as a suds boosting agent. However, among the recited objects of the patent is to provide detergent compositions featuring good grease removal while simultaneously being mild to the skin, technical features which do not generally arise in laundry detergent compositions. Further, there is no mention in the specification of the use of such compositions in a laundry application, particularly a machine washing laundering application.

U.S. Pat. No. 5,230,823 to Wise et al. teaches certain light duty or gel dishwashing detergent compositions which comprise from 5 to 70% by weight of a surfactant mixture comprising: (a) 80 to 100% of an alkyl ethoxy carboxylate of the formula: $RO(CH_2CH_2O)_xCH_2COO^-M^+$ wherein $M^+$ is a cation; (b) 0–10% of alcohol ethoxylates according to the formula: $RO(CH_2CH_2O)_xH$; (c) 0–10% of a soap based upon the formula: $RCOO^-M^+$, wherein a 10% by weight aqueous solution of the cleaning composition exhibits a pH of from 7–11. As opposed to U.S. Pat. No. 5,378,409 discuss supra, compositions according to U.S. Pat. No. 5,230,823 teaches the utility of ions, including magnesium and calcium ions of which magnesium ions are particularly preferred. Also taught as an optional constituent in the compositions according to Wise et al., are certain cationic quaternary ammonium surfactants which are taught to be as suds boosters, i.e., suds stabilizing surfactants. However, as in U.S. Pat. No. 5,378,409 to Ofosu-Asante et al., the recited objects of the patent include the provision of dishwashing detergent compositions featuring good grease removal while simultaneously being mild to the skin, technical features which do not generally arise in laundry detergent compositions. Further, there is no mention in the specification of the use of such compositions in a laundry application, particularly a machine washing laundering application.

U.S. Pat. No. 4,364,457 to Beeks et al. disclose a cationic liquid laundry detergent and fabric softener comprising 3 to 35% nonionic surfactant, 3 to 30% quaternary ammonium surfactant, and a mixture of anionic surfactants selected from alkyl sulfates, alkyl ethersulfates and alkyl ethercarboxylates in which the ratio total cationic to total anionic surfactants is from 0.8:1 to 10:1. The specification makes no reference to any antibacterial properties of the composition.

U.S. Pat. No. 4,333,862 to Smith et al. disclose a liquid detergent composition comprising from 2–100% of a surfactant system consisting essentially of a water soluble combination of anionic, nonionic and quaternary ammonium surfactants wherein the anionic:cationic ratio is less than 5:1 but at least 1:1 and the nonionic:cationic ratio is from 5:1 to 2:3. The specification makes no mention of any antibacterial properties.

U.S. Pat. No. 5,151,223, U.S. Pat. No. 4,547,300 and U.S. Pat. No. 4,233,167 are all directed to compositions which include optical brighteners and which further include quaternary ammonium compounds as fabric softener additives.

Commonly assigned and copending patent application U.S. Ser. No. 08/666,897 describes liquid laundry detergent compositions which comprise: one or more anionic surfactant compositions selected from alkylethercarboxylates and alkylethersulfonates; at least one quaternary ammonium surfactant compositions having germicidal properties; one or more nonionic surfactant compositions selected from linear and secondary alcohol alkoxylates, alkylphenol ethoxylates, alkyl polyglycosides, amine oxides, alkanolamides; and optionally one or more anionic co-surfactant compositions. While certain of the compositions described in that application include certain optical brighteners, as will be described and demonstrated in more detail hereinafter, such compositions according to U.S. Ser. No. 08/666,897 are only poor to fair in their optical brightening characteristics especially subsequent to repeated washings of garments.

While these compositions provide certain advantageous features, the remains a real and continuing need in the art for improved liquid laundry detergent compositions which concurrently provide good detersive properties, an effective sanitizing benefit to laundered textiles and garments, and further concurrently feature excellent optical brightening characteristics especially after repeated washings.

Accordingly there remains a need in the art for improved laundry detergent compositions, particularly those which provide good cleaning efficacy as well as an antibacterial effect so to effectively sanitize treated textiles or garments.

Therefore, it is an object of the invention to provide improved laundry detergent compositions, more particularly to provide improved aqueous laundry detergent compositions in a concentrated form, which laundry detergent compositions provide good detersive and good sanitizing effects, and which feature excellent optical brightening characteristics especially after repeated washings.

It is a further object of the invention to provide certain aqueous germicidal active laundry detergent compositions which include specific combinations of constituents which provide for the formulation of laundry detergent compositions which concurrently provide good detersive and good sanitizing effects, as well as featuring excellent optical brightening characteristics.

Such compositions are particularly useful in the laundering of garments and/or textiles particularly when used in conjunction with commercial or residential washing machine designed for the laundering of garments and/or textiles.

According to the invention there is provided an aqueous, germicidal liquid detergent composition comprising:

A) a major anionic surfactant constituent selected from alkylethercarboxylates and alkylethersulfonates;

B) a cationic germicidal surfactant;

C) a nonionic surfactant preferably selected from alcoholalkoxylates, alkylphenol alkoxylates, alkylpolyglycosides, amine oxides and alkanolamides, wherein the value of the cationic surfactant to the major anionic surfactant is 1:2 or greater; and, D) a compatible optical brightener constituent.

The composition may optionally contain further anionic surfactants, wherein the value of the cationic to optional further anionic surfactants is critically maintained at a weight value of 2:1 and greater.

In accordance with preferred aspects of the present invention, there are provided aqueous germicidal liquid laundry detergent compositions in concentrated form, which composition comprises water, and the following constituents A) 2–20 parts by weight of one or more anionic surfactants selected from alkylethercarboxylates and alkylethersulfonates;

B) 1–25 parts by weight of one or more quaternary ammonium surfactant having germicidal properties;

C) 2–40 parts by weight of one or more nonionic surfactant selected from linear and secondary alcohol alkoxylates, alkylphenol ethoxylates, alkyl polyglycosides, amine oxides, and alkanolamides;

D) 0.001–1 parts by weight of a compatible optical brightener constituent.

E) 0–10 parts by weight of one or more further anionic surfactants selected from alkylsulfates, alkylsulfonates, alkylethersulfates, alkylarylsulfonates, alkylarylethersulfates which are present in a proportion not to exceed one half of the weight of the one or more quaternary ammonium surfactants; with the proviso that the weight ratios of B:A be within the weight ratio of 1:2 or greater.

Where the detergent compositions includes a further anionic surfactant E, it is present in amounts where the weight value of B to E is 2:1, or greater.

It is to be understood that the amounts of the named surfactants refers to the amount of actives in the respective surfactant preparation. The compositions of the invention may further comprise optional constituents, many of which are well known to the art, including but are not limited to: detergency builders, chelating agents, pH adjusting agents, pH stabilizing agents (buffers), hydrotropes, optical brighteners, coloring agents, fragrances, fillers, as well as others not particularly elucidated here. These optional constituents may be added in any effective amount, but generally the total amount of such optional constituents does not exceed about 10 parts by weight of the total weight of the detergent compositions being taught herein.

Surfactants which find use in the present inventive compositions include materials which are known to the art and include those described in *McCutcheon's Detergents and Emulsifiers,* Vol. 1, North American Edition, 1991; as well as from *Kirk-Othmer, Encyclopedia of Chemical Technology,* 3rd Ed., Vol. 22, pp. 346–387, the contents of which are herein incorporated by reference. The conventional additives which may be further included as one or more of the optional constituents include materials which are also known to the art, and include materials described in the references noted above, as well as in *McCutcheon's Functional Materials,* Vol. 2, North American Edition, 1991

Constituent (A) Particularly useful anionic surfactants which find use in the detergent compositions according to the present invention include at least one alkylethercarboxylate surfactant, and/or at least one alkylethersulfonate surfactant.

Useful alkylethercarboxylate surfactants include compounds according to the formula:

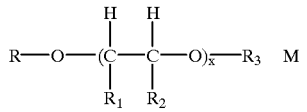

where:

R is a $C_4$–$C_{22}$ linear or branched alkyl group, preferably $C_8$–$C_{15}$ linear or branched alkyl group, and yet more preferably a $C_{12-15}$ linear or branched alkyl group;

x is an integer from 1 to 24, $R_1$, $R_2$ and $R_3$ is a group selected from H, lower alkyl radicals including methyl and ethyl radicals, carboxylate radicals including acetate and propionate radicals, succinate radicals, hydroxysuccinate radicals, or mixtures thereof wherein at least one $R_1$, $R_2$ or $R_3$ is a carboxylate, succinate or hydroxysuccinate radical; and, $M^+$ is a counterion including an alkali metal or ammonium counterion.

Free acid forms of the alkylethercarboxylate compounds noted above may also be used. Preferably, the alkylethercarboxylate compound is one wherein R is $C_{12}$–$C_{15}$, x is an integer from 1–10 inclusive, and $R_1$, $R_2$, and $R_3$ which may be the same or different are preferably selected from H, and carboxylate radicals. Most preferred are alkylethercarboxylate compounds wherein R is $C_{12}$–$C_{15}$, x is an integer from 1–10 inclusive, and $R_1$ and $R_2$ are both hydrogen, and $R_3$ is a $CH_2COO^-$ radical, and $M^+$ is a counterion selected from sodium, potassium and ammonium counterions. Such alkylethercarboxylate compounds are per se known and are available in commercial preparations wherein they are frequently provided with an aqueous carrier. Examples of such presently available commercial preparations include SURFINE WLG (Finetex Inc., Elmwood Park N.J.), SANDOPAN DTC (Clariant Chem. Co., Charlotte N.C.) in salt forms, and in free acid forms include those marketed under the tradename NEODOX (Shell Chemical Co., Houston Tex.).

Alternatively, or in addition to the alkylethercarboxylate surfactants noted above, there may be used one or more alkylethersulfonate surfactants.

Exemplary alkylethersulfonate surfactants which may be used include those according to the formula:

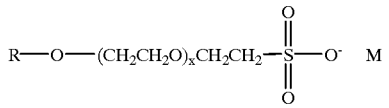

where:

R is a $C_4$–$C_{22}$ linear or branched alkyl group, preferably $C_8$–$C_{15}$ linear or branched alkyl group, and yet more preferably a $C_{12-15}$ linear or branched alkyl group;

x is an integer from 1 to 24, and, $M^+$ is alkali metal or ammonium counterion.

Free acid forms of the alkylethersulfonate compounds noted above may also be used. Preferably, the alkylethersulfonate compound is one wherein R is $C_{12}$–$C_{15}$, x is 1–10 and $M^+$ is a counterion selected from sodium, potassium and ammonium counterions.

Such alkylethersulfonate compounds are known and are available in commercial preparations wherein they are frequently provided with an aqueous carrier. Examples of such commercially available preparations include AVANEL S30 and AVANEL S70 (PPG Industries, Pittsburgh Pa.)

In the concentrated liquid detergent compositions according to the invention, the anionic surfactant of Constituent (A) comprises from 1–40 parts by weight of the liquid detergent compositions, more preferably comprise from 5–30 parts by weight of the active constituents of the liquid detergent compositions, but most preferably comprise from 10–20 parts by weight of the active constituents of the liquid detergent compositions.

According to particularly preferred embodiments, the anionic surfactant constituent (A) consists solely of an alkylethercarboxylate or an alkylethersulfonate surfactant.

Constituent (B) Cationic surfactants which exhibit germicidal activity and which may be used in the detergent compositions include certain quaternary ammonium surfactants, of which one or more such cationic surfactants may be used as the present Constituent (B). Particularly useful quaternary ammonium compounds and salts thereof include quaternary ammonium germicides which may be characterized by the general structural formula:

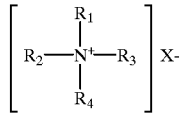

where at least one or $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

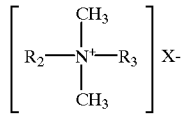

wherein $R_2$ and $R_3$ are the same or different $C_8$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or methosulfate. The alkyl groups recited in $R_2$ and $R_3$ may be straight chained or branched, but are preferably substantially linear.

Particularly useful quaternary germicides include compositions which include a single quaternary compound, as well as mixtures of two or more different quaternary compounds. Particularly useful quaternary germicides include BARDAC® D 205M, and BARDAC® 208M or BTC® 885 which is described to be a blend of alkyl dimethyl benzyl ammonium chlorides; BARDAC® 2050 and BARDAC® 2080 or BTC® 818 which is described to be based on dialkyl($C_8$–$C_{10}$)dimethyl ammonium chloride; BARDAC® 2250 and BARDAC® 2280 or BTC® 1010 which is described to a composition which includes didecyl dimethyl ammonium chloride; BARDAC® LF and BARDAC® LF 80 which is described to be based on dioctyl dimethyl ammonium chloride; BARQUAT® MB-50, HYAMINE® 3500, BARQUAT® MB-80, BTC® 835 or BTC 8358 each described to be based on alkyl dimethyl benzyl ammonium chloride; BARQUAT® MX-50, BARQUAT® MX-80, BTC® 824 or BTC® 8248 each described to be a composition based on alkyl dimethyl benzyl ammonium chloride; BARQUAT® OJ-50, BARQUAT® OJ-80, BTC® 2565, or BTC® 2658 each described to be a composition based on alkyl dimethyl benzyl ammonium chloride; BARQUAT® 4250, BARQUAT® 4280, BARQUAT® 4250Z, BARQUAT® 4280Z, BTC® 2125, or BTC® 2125M each described to be a composition based on alkyl dimethyl benzyl ammonium chloride and/or alkyl dimethyl ethyl benzyl ammonium chloride; BARQUAT® MS-100 or BTC® 324-P-100 each described to be based on myristyl dimethyl benzyl ammonium chloride; HYAMINE® 2389 described to be based on methyl dodecyl benzyl ammonium chloride and/or methyl dodecyl xylene-bis-trimethyl ammonium chloride; HYAMINE® 1622 described to be an aqueous solution of benzethonium chloride; HYAMINE® 3500-NF or BTC® 50 each described to be based on alkyl dimethyl benzyl ammonium chloride; as well as BARQUAT® 1552 or BTC® 776 described to be based on alkyl dimethyl benzyl ammonium chloride and/or dialkyl methyl benzyl ammonium chloride. (Each of these recited materials are presently commercially available from Lonza, Inc., Fairlawn, N.J. and/or from Stepan Co., Northfield Ill.)

In the liquid laundry detergent compositions according to the invention Constituent (B) comprises from 1–25 parts by weight of the active constituents of the detergent compositions, more preferably comprise from 2–20 parts by weight, and most preferably comprise from 3–7 parts by weight of the active constituents of the liquid detergent compositions.

The present inventor have surprisingly found that effective germicidal efficacy of the detergent composition when diluted to form a wash bath as indicated in more detail below wherein the weight ratios of such actives of Constituent (B):Constituent (A) is at least 1:2, or greater such as 1.5:2, 2:2, 2.5:2 and even greater proportions of Constituent (B) to Constituent (A).

Constituent (C) The compositions according to the present invention further comprise one or more nonionic surfactants selected from surfactants based upon linear and secondary alcohols, alkylphenol ethoxylates, alkyl polyglycosides, amine oxides, and, alkanolamides. Such nonionic surfactants are known and are available in commercial preparations, certain such commercial preparations providing the surfactant compound in conjunction with an aqueous carrier.

Useful nonionic surfactants include the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide, tridecanol condensed with about 6 to moles of ethylene oxide, myristyl alcohol condensed with about 10 moles of ethylene oxide per mole of myristyl alcohol, the condensation product of ethylene oxide with a distillation fraction of cut of coconut fatty alcohol containing a mixture of fatty alcohols with alkyl chains varying from 10 to about 14 carbon atoms in length and wherein the condensate contains either about 6 moles of ethylene oxide per mole of total alcohol or about 9 moles of ethylene oxide per mole of alcohol and tallow alcohol ethoxylates containing 6 ethylene oxide to 11 ethylene oxide per mole of alcohol.

A preferred group of nonionic surfactants are those which are presently being marketed under the trade name, "NEODOL" (Shell Chemical. Co., Houston Tex.) These nonionic surface active agents are believed to be ethoxylated higher aliphatic, primary alcohol containing about 9–15 carbon atoms, such as $C_9$–$C_{11}$ alkanol condensed with 8 moles of ethylene oxide (NEODOL 91-8), $C_{12-13}$ alkanol condensed with 6.5 moles ethylene oxide (NEODOL 23-6.5), $C_{12-15}$ alkanol condensed with 12 moles ethylene oxide (NEODOL 25-12), $C_{14-15}$ alkanol condensed with 13 moles ethylene oxide (NEODOL 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Such nonionic surfactants are presently commercially available under the trade name "TERGITOL" (Union Carbide Corp., Danbury, Conn.). Specific examples of such commercially available nonionic surfactants of the foregoing type are $C_{11}$–$C_{15}$ secondary alkanols condensed with either 9 ethylene oxide (TERGITOL 15-S-9) or 12 ethylene oxide (TERGITOL 15-S-12) marketed by Union Carbide Corp., (Danbury, Conn.).

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of ethylene oxide per mole of nonyl phenol, dinonyl phenol condensed with about 12 moles of ethylene oxide per mole of phenol, dinonyl phenol condensed with about 15 moles of ethylene oxide per mole of phenol and diisoctylphenol condensed with about 15 moles of ethylene oxide per mole of phenol. Commercially available nonionic surfactants of this type include IGEPAL CO-630 (a nonyl phenol ethoxylate) marketed by ISP Corp. (Wayne, N.J.). Further exemplary commercially available nonionic surfactants include ethoxylated octyl and nonyl phenols which are particularly useful in the present inventive compositions include those having one of the following general structural formulas:

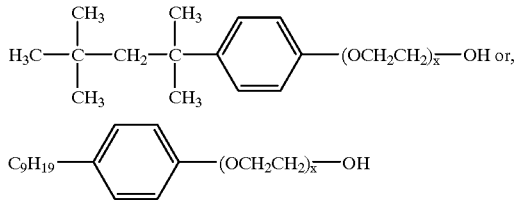

in which the $C_9H_{19}$ group in the latter formula is a mixture of branched chained isomers, and x indicates an average number of ethoxy units in the side chain. Suitable non-ionic ethoxylated octyl and nonyl phenols include those having from about 7 to about 13 ethoxy units. Such compounds are commercially available under the trade name Triton® X (Union Carbide, Danbury Conn.).

Alkyl polyglycosides may also be used as a nonionic surfactant in the present inventive compositions. Suitable alkyl polyglycosides are known nonionic surfactants which are alkaline and electrolyte stable. Alkyl mono and polyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for making them are disclosed in U.S. Pat. No. 2,974,134; U.S. Pat. No. 3,219,656; U.S. Pat. No. 3,598,865; U.S. Pat. No. 3,640,998; U.S. Pat. No. 3,707,535; U.S. Pat. No. 3,772,269; U.S. Pat. No. 3,839,318; U.S. Pat. No. 3,974,138; U.S. Pat. No. 4,223,129; and U.S. Pat. No. 4,528,106.

A preferred group of alkyl glycoside surfactants suitable for use in the practice of this invention may be represented by formula I below:

$$RO—(R_1O)_y\text{-}(G)_xZ_b$$

wherein:

R is a monovalent organic radical containing from about 6 to about 30, preferably from about 8 to about 18 carbon atoms;

$R_1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$,

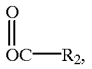

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a

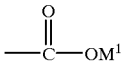

group);

b is a number of from 0 to 3x+1 preferably an average of from 0.5 to 2 per glycosal group;

p is 1 to 10, $M^1$ is $H^+$ or an organic or inorganic cation, such as, for example, an alkali metal, ammonium, monoethanolamine, or calcium.

As defined in Formula I above, R is generally the residue of a fatty alcohol having from about 8 to 30 and preferably 8 to 18 carbon atoms. A preferred alkyl polyglycoside is APG™ 325 CS GLYCOSIDE which is described as being a 50% $C_9$–$C_{11}$ alkyl polyglycoside, also commonly referred to as D-glucopyranoside, and also preferred is GLUCOPON™ 625 CS which is described as being a 50% $C_{10}$–$C_{16}$ alkyl polyglycoside, also commonly referred to as a D-glucopyranoside, (both commercially available from Henkel Corp., Ambler Pa.).

Also useful in the nonionic surfactant constituent of the invention are nonionic surfactant compositions based on amine oxides.

One general class of useful amine oxides include alkyl di (lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include lauryl, dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide.

A further class of useful amine oxides include alkyl di (hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallow amine oxide, and bis(2-hydroxyethyl) stearylamine oxide.

Further useful amine oxides include those which may be characterized as alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and Additional useful amine oxides include those which may be referred to as alkylmorpholine oxides in which the alkyl group has about 10–20, and preferably 12–16 carbon atoms, and can be straight or branched chain, saturated or unsaturated.

Further examples of such useful include nonionic surfactant compositions based on amine oxides include those which are presently commercially available and include those under the trade name AMMONYX (Stepan Co., Chicago Ill.).

In the concentrated liquid detergent compositions according to the invention Constituent (C) comprises from 3–50 parts by weight of the actives constituent in the detergent compositions taught herein. More preferably, the nonionic surfactant composition comprise from 5–30 parts by weight, and most preferably comprise from 10–25 parts by weight of the actives constituent of the present inventive liquid detergent compositions.

Constituent (D) The compositions according to the invention further include an effective amount of at least one compatible optical brightener constituent.

Whereas the prior art is replete with references to the use of such optical brightener constituents in laundry detergent applications, the prior art fails to take into consideration the production of a germicidal liquid laundry detergent composition which on the one hand provides effective germicidal action to garments being laundered and at the same time, provides good wash and appearance characteristics to laundered articles and textiles, especially light colored articles and textiles, inter alia, white. In contrast to many prior art liquid laundry detergent composition, the presence of the cationic germicidal quaternary surfactant of Constituent (B) has been found to render most stilbene based optical brighteners incompatible in formulations as such optical brighteners are very frequently highly anionic in nature and form complexes with cationic compounds, and thereby deactivate the activity of both themselves and the cationic compounds. In germicidal liquid laundry detergent compositions such as those taught herein, the inventor has found that the simple addition of optical brightener constituents complexes with the germicidal quaternary ammonium compound and undesirably deactivates both the germicidal activity and the optical brightening characteristics of the detergent compositions. Thus, the formulation of a successful germicidal liquid laundry detergent composition is not an obvious or trivial exercise for one skilled in the art.

Exemplary stilbene based optical brighteners include those which may be represented by the general structure:

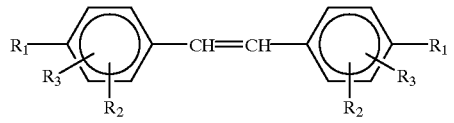

wherein:

each $R_1$ may be the same or different and are selected from substituted and unsubstituted groups including but not limited to: hydrogen, alkyl especially lower alkyl, benzyl, alkoxy, especially lower alkoxy such as ethoxy and propoxy, hydroxy, $—SO_3H$,

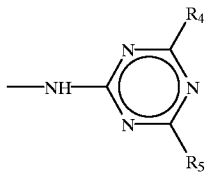

-continued

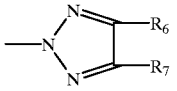

each $R_2$ and $R_3$ which may be the same or different is selected from hydrogen, alkyl especially lower alkyl, benzyl, alkoxy, especially lower alkoxy such as ethoxy and propoxy, hydroxy, —$SO_3H$, halo, CN, alkyl sulfonyl, or esters such —COO-alkyl or —COO-aryl the alkyl or aryl groups of which esters may be optionally substituted, but most desirably $R_2$ and $R_3$ is hydrogen or —$SO_3H$;

each $R_4$ and $R_5$ which may be the same or different may be any of a variety of substituted and unsubstituted groups including but not limited to: hydrogen, alkyl, benzyl, alkoxy, hydroxy, —$NHC_6H_5$, —$OCH_3$, —$SO_3H$,

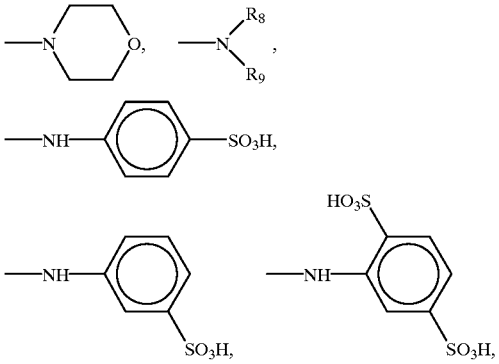

as well as other substituent groups, which may be unsubstituted or optionally substituted, although not recited here;

each $R_6$ and $R_7$, which may be the same or different include substituted and unsubstituted groups including but not limited to halo, lower alkyl, lower alkoxy, —CN, —COOH, esters such —COO-alkyl or —COO-aryl, or which may together form a 4, 5 or 6 membered heterocyclic ring; and, each $R_8$ and $R_9$ which may be the same or different is selected from hydrogen, lower alkyl, especially $C_1$–$C_6$, and more especially $C_1$–$C_3$, hydroxy, alkoxy especially ethoxy, propoxy or butoxy.

By way of illustration but not limitation groups useful in as substituent groups denoted above include halo, amino, lower alkyl, and lower alkoxy.

Preferred stilbene based optical brighteners are typically the symmetric or asymmetric derivatives of 4,4'-diaminostilbene-2,2'-disulfonic acid which may be generally represented as:

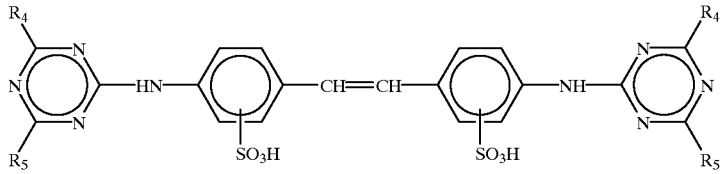

wherein $R_4$ and $R_5$ are as described above, but are preferably selected from:

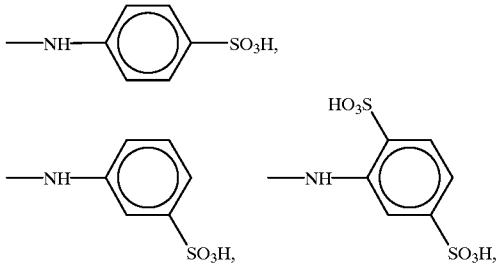

and,

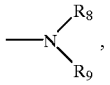

as defined above.

Further exemplary stilbene based optical brighteners are described in U.S. Pat. No. 3,761,470, the contents of which are herein incorporated by reference.

Various materials of the classes described above may be obtained from a variety of commercial sources including but not limited to products currently marketed under the trade names Phorwite® which are marketed for whitening of paper and Blancophor® especially Blancophor® TX which is marketed for whitening of textile and laundry (Bayer Corp., Pittsburgh, Pa. and Bayer AG, Leverkusen, Germany); Leucophor® (Clariant Corporation, Charlotte N.C. and Clariant AG, Muttenz, Switzerland), Tinopal® (Ciba-Geigy Corp., Greensboro, N.C. and Ciba-Geigy AG, Basle, Switzerland). Such products are usually provided in an aqueous carrier medium, and may be provided in free acid form, or in a salt forms of their corresponding acids, i.e., sodium, potassium, or other alkaline metal or alkaline earth metal salts.

The inventor has surprisingly discovered that the stilbene based optical brighteners having three or more sulfate groups and/or sulfonic acid groups per molecule forming part of the germicidal liquid laundry detergent compositions taught herein provide the benefit of excellent optical brightening and apparent whitening of laundered garments or textiles, and at the same time do not deleteriously complex with the germicidal quaternary ammonium compounds such to deleteriously effect the sanitizing properties of the laundry detergent compositions.

An exemplary particularly preferred compatible optical brightener is a compound according to:

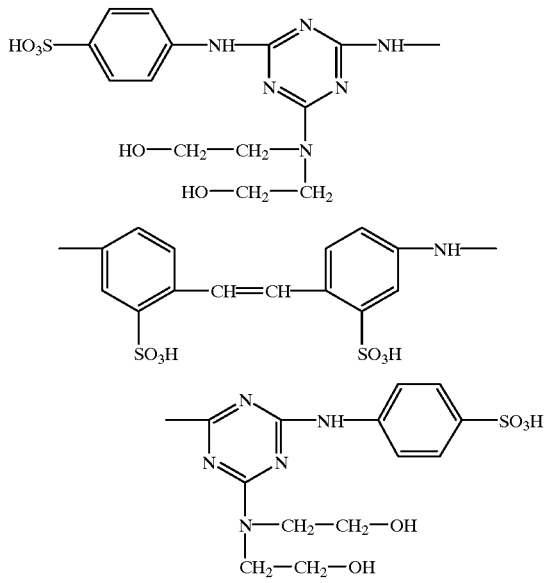

Such is presently available in a commercial preparation as PHORWITE® P-150 from the Bayer Corp. (Pittsburgh, Pa.), and includes four sulfur containing groups.

While the compatible optical brightener constituent may be used in any effective amount, typically at least 0.001% wt., but desirably it forms not more than about 1% wt. of the compositions according to the invention. Still more desirably the compatible optical brightener constituent forms from 0.2–0.8% wt. of the inventive composition, and most desirably is present in amounts of from 0.25–0.5% wt., each of these weights being based on the amount of actives in the commercially supplied optical brightener preparation.

Constituent (E) While not always included in compositions according to the present invention, the present inventors have found that a minor amount of a further anionic co-surfactant provides further detersive action and foaming action. Such a further anionic surfactant is present in a relatively small amount, i.e., less than 10 parts by weight based on the total weight of the liquid detergent composition, with the further limitation that such anionic co-surfactant is present in an amount of no more than ½ of the total weight of Constituent (B).

Anionic surfactants which are useful for use as the recited anionic co-surfactant which may be any anionic surfactant which is determined not to undesirably detract from the efficacy of Constituent (B) when included in a formulation within the scope of the instant invention. Known anionic surfactants may be used, including for example, alkali metal salts or ammonium salts of compounds selected from certain alkylsulfates, alkylsulfonates, alkylethersulfates, alkylarylsulfonates, alkylarylethersulfates, and mixtures thereof.

A further class of useful anionic surfactants which find use as the co-surfactant recited herein include alkyl ethersulfates and salts thereof, especially one or more alkyl ethersulfates which may be represented by the following general formula:

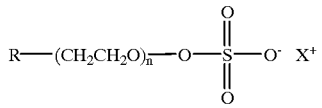

wherein R is a $C_8$–$C_{18}$ alkyl group, n is an integer from 1 to 30, and X represents an counterion selected from alkaline earth metals and ammonium. Of these alkyl ethersulfates, especially preferred are those wherein R is a $C_{12}$–$C_{15}$ group, n is 4, and X is a sodium cation or is an ammonium cation, i.e., $NH_4^+$. Such alkyl ether sulfates may be produced by known methods, or in the alternative are presently commercially available under the trade name "STEOL" (Stepan Chem. Co., Chicago Ill.).

Such anionic surfactants are known and are available in commercial preparations wherein they are frequently provided in conjunction with an aqueous carrier. Further useful anionic surfactants useful as the co-surfactant include those illustrated in the Examples, below. Of course, it is to be understood that one or more anionic surfactants may be used to provide the anionic co-surfactants according to Constituent (E).

As indicated above, when present, the anionic co-surfactant according to Constituent (E) comprises from 0–10 parts by weight of the liquid detergent compositions of the present invention. More preferably the anionic co-surfactant comprises from 1–8 parts by weight, and most preferably comprise from 2–5 parts by weight of the liquid detergent compositions, with the proviso that the weight ratios of the cationic surfactant composition of Constituent (B): the anionic co-surfactant composition of Constituent (E) is at least 2:1, but are preferably greater, and most preferably in a ratio of at least 2.5:1.

Optionally, the compositions include up to 10% by weight of conventional laundry detergent additives as known in the art including but not limited to: builders and chelating agents, pH adjusters, stabilizers, rheology modifying agents, sequestrants, optical brighteners, solvents including alcohols such as ethanol and propylene glycol, hydrotropes such as sodium and potassium aryl sulfones and alkarylsulfonates, coloring agents, and fragrances. Many of these are known to the art, and include those which are described in *McCutcheon's Functional Materials,* Vol. 2, North American Edition, (1991), and each may be included at effective concentrations, with the total of such optional constituents preferably not exceeding 10% by weight of the total liquid laundry detergent composition taught herein.

For the stabilization of the inventive composition the use of pH stabilizing agents, interchangeably referred to as pH buffers, the inclusion of any pH buffering compound or pH buffer composition which is compatible with the aqueous compositions taught herein may be used, including many which are well known to the art. Examples of such useful pH buffer compounds and/or pH buffering systems or compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Such buffers keep the pH ranges of the compositions of the present invention within acceptable limits. Other pH buffers, not particularly elucidated here may also be used. Preferably, citric acid, which is available as an anhydrous salt of an alkali metal citric acid, is added as it is readily commercially available, and effective. Citric acid is preferred as it is effective and is widely available at a low cost.

As noted above, the compositions of the invention when diluted to form a 0.20% solution in water which is equivalent to a dilution of 1 part of the inventive composition to 500 parts water, preferably deionized water, exhibit a pH in the range of 5–10, more preferably a pH in the range 7–8, and most preferably a pH of about 8. The incorporation of an effective amount of such a pH stabilizing agent provides the technical benefits of ensuring the stability of the compositions of the invention as formulated, and as used when added to an excess of water to form a cleaning composition therefrom. As is known to those skilled in the relevant art, various stains and food deposits may impart an appreciable change in the pH of water from an approximately neutral pH to that of an acidic or basic pH. The inclusion of an effective amount of a pH stabilizing agent in the compositions, when added to the excess of water will tend to return the pH of a cleaning composition to a more neutral pH. While it will be realized that the selection of the other constituents forming the inventive compositions may necessitate varying amounts of a pH buffer composition, the buffer composition generally is included in effective amounts which are conventionally determinable in order to adjust the pH of the diluted compositions to the indicated pH ranges, particularly to the preferred pH ranges indicated above.

A further optional constituent which may be desirably included in the inventive compositions include a detergency builder component. Detergency builders, of the organic or inorganic type may be desirably included in the present inventive compositions. Exemplary builders include water soluble inorganic builders which can be used alone, in admixture with other water soluble inorganic builders, as well as in conjunction with one or more organic alkaline sequestrant builder salt. When present, the detergency builder component generally is included to comprise up to 6 parts by weight, but preferably only up to 5 parts by weight of the composition.

Exemplary detergency builders include alkali metal carbonates, phosphates, polyphosphates and silicates. More specific examples include sodium tripolyphosphate, sodium carbonate, potassium carbonate, sodium polyphosphate, potassium pyrophosphate, potassium tripolyphosphate, and sodium hexametaphosphate.

Exemplary organic alkaline sequestrant builder salts include alkali metal polycarboxylates including water-soluble citrates such as calcium, sodium and potassium citrate, calcium, sodium and potassium tartarate, calcium, sodium and potassium ethylenediaminetetraacetate, calcium, sodium and potassium N-(2-hydroxyethyl)-ethylene diamine triacetates, calcium, sodium and potassium nitrilo triacetates, as well as calcium, sodium and potassium tartrate or mono- and di-succinates. As noted, these organic builder salts may be used individually, as a combination of two or more organic builder salts, as well as in conjunction with one or more detergency builders, including those indicated above. Of these, especially preferred are ethylenediaminetetraacetic acid, and salts thereof particularly calcium and sodium salts thereof, and HEDTA and salts thereof. Other known art chelating agents may be used, including sodium gluconate, gluconic acid and salts thereof and sorbitol may also be used.

Further optional, but frequently desirable constituents include fragrances, which may be derived from natural sources or which may be synthetically produced. Such fragrances are known to the art, and may be added in any conventional manner, such as by admixing to a concentrate composition or blending with other constituents used to form a concentrate composition, in amounts which are found to be useful to enhance or impart the desired scent characteristic to the concentrate composition, and/or to cleaning compositions formed therefrom.

Further optional, but advantageously included constituents are one or more coloring agents which find use in modifying the appearance of the concentrate compositions and enhance their appearance from the perspective of a consumer or other end user. Known coloring agents, may be incorporated in the compositions in any effective amount to improve or impart to concentrate compositions a desired appearance or color. Such a coloring agent or coloring agents may be added in a conventional fashion, i.e., admixing to a concentrate composition or blending with other constituents used to form a concentrate composition.

Water forms a constituent of the concentrated liquid detergent compositions and the water may be tap water, but is preferably distilled and/or deionized water. If the water is tap water, it is preferably appropriately filtered in order to remove any undesirable impurities such as organics or inorganics, especially mineral salts which are present in hard water which may thus interfere with the operation of the invention. The amount of water added is an amount to provide the balance of the composition to provide 100 parts by weight. Generally, the water is added, generally in an amount of 40 to 95 parts by weight, so to provide the balance of the total inventive composition. It is to be recognized that one or more of the constituents according to the invention may be commercially available as aqueous mixtures comprising one or more actives constituents, in which case their aqueous portion is to be considered separately from the actives portion, as has been noted above. Also, as has been previously noted, up to 10 parts by weight of the total liquid laundry detergent composition may be comprised of the one or more optional conventional laundry detergent additives and accordingly, the total amount of water may be proportionately reduced to allow the addition of such further optional additives.

The compositions according to the present invention are particularly useful as an aqueous liquid detergent in concentrated form. The critical components of the composition are the predominant anionic surfactants according to Constituent (A), viz., the alkylethercarboxylate, and/or alkylethersulfonate and Constituent (C), viz., the one or more quaternary ammonium surfactants. We have surprisingly discovered that the critically selected anionic surfactants are compatible with quaternary ammonium germicides in the recited proportions, and thereby up to very high ratios of anionic surfactant:cationic quaternary ammonium surfactant are now obtainable in accordance with the present inventive teaching, as compared with prior art teachings relating to the compatibility between anionic and cationic surfactants. By compatibility, it is meant that these critically selected anionic surfactants do not impair the antimicrobial activity of the quaternary component to any significant degree. This is in sharp contrast to other anionic surfactants, which significantly impair the antibacterial activity of quaternaries, as has been recited in the prior art and exemplified below. The surprising discovery described in the instant invention allows the formulation of unique and useful detergent compositions which simultaneously provides excellent cleaning combined with uncompromised antibacterial protection, even in formulations with high levels of anionic surfactant.

The compositions according to the invention are prepared by dissolving the individual constituents in order to provide a liquid concentrate. In use, the concentrate is added to the wash water in an amount effective to achieve either cleaning and brightening as well as sanitization of the fabrics or garments being washed. It has been found that from approximately ½ to about ¾ cup of the liquid laundry detergent concentrate compositions per wash load (domestic washing machine) is generally adequate to achieve good cleaning and sanitization of such a domestic wash load. Thus, based on the total wash water volume of approximately 16 gallons of water, the compositions can be used at dilutions of the concentrated composition:water from about 1:500 to 1:330, although even lower dilutions may be also used and provide such excellent cleaning and sanitization effects. Conventional washing machines may be used utilizing conventional washing cycles, particularly wherein the wash water is at a temperature in the range of 20° C.–40° C. degrees, and for a bath contact time of 10–20 minutes.

EXAMPLES

Preparation of Example Formulations

Several laundry detergent formulations according to the invention were prepared, as well as comparative examples, all of which are described in detail on Table 1, below. The examples prefixed with the letter "E" are illustrative of formulations which are in accordance with the present inventive teaching. The comparative examples, prefixed with the letter "C" describe compositions having similar constituents, which however fall outside of the scope of the present inventive teaching. The percentage of actives of each of the particular constituents indicated on Table 1, as "as supplied" weights of the named constituent and their identity and particular weight percentage of actives is succinctly provided in Table 2, below.

These formulations were prepared by adding a measured amount of deionized water to a suitable glass beaker, and utilizing a magnetic stirrer, stirring the water during the addition of the further measured amounts of the remaining constituents to the water. In certain of the formulations, an amount of sodium hydroxide was added in sufficient amounts to neutralize any surfactants which may have been provided in a free acid form. Afterwards, the formulations were stirred for a further 15 to 30 minutes using a magnetic stirring bar, and in each case the formulations resulted in a homogeneous liquid, suitable for use as a laundry detergent at a dilution of about 1:500 in a household washing machine.

TABLE 1

| | C1 | C2 | C3 | C4 | C5 | C6 | C7 | C8 | C9 | E1 |
|---|---|---|---|---|---|---|---|---|---|---|
| Neodox 25-6 | 7.24 | 7.24 | | 7.07 | 7.07 | 7.07 | 7.07 | 7.07 | 7.07 | 7.24 |
| Neodol 25-7 | 10.0 | 10.0 | | 10.0 | 10.0 | 10.0 | 10.0 | 10.0 | 10.0 | 10.0 |
| Neodol 45-7 | | | 12.0 | | | | | | | |
| BTC-8358 | 8.0 | | 8.0 | | | | | | | |
| Barquat MB-50 | | 8.0 | | | | | | | | |
| Bardac LF | | | | 7.50 | | | | | | 10.0 |
| Steol CS-460 | | | 6.0 | | | | | | | |
| Stepanate SXS | | | 5.0 | | | | | | | |
| Blancophor TX | 3.0 | 3.0 | 3.0 | | | | | | | |
| Blancophor REU-170 | | | | | 7.50 | | | | | |
| Blancophor BBH | | | | | | 7.50 | | | | |
| Blancophor HRS | | | | | | | 7.50 | | | |
| Blancophor DML | | | | | | | | 7.50 | | |
| Tinopal DCS | | | | | | | | | | 1.0 |
| Leucophor BSB | | | | | | | | | 7.50 | |
| Phorwite P-150 | | | | 1.79 | 1.79 | 1.79 | 1.79 | 1.79 | 1.79 | |
| Phorwite BBU | | | | | | | | | | |
| Phorwite UW | | | | | | | | | | |
| Phorwite DE | | | | | | | | | | |
| Phorwite BRU | | | | | | | | | | |
| Phorwite AR | | | | | | | | | | |
| sodium benzoate | | | 2.0 | | | | | | | |
| glycerine | | | 2.0 | | | | | | | |
| sodium hydroxide | 0.80 | 0.80 | | 0.80 | 0.80 | 0.80 | 0.80 | 0.80 | 0.80 | 0.80 |
| fragrance | | | 0.5 | | | | | | | |
| dye | | | 0.5 | | | | | | | |
| water | q.s. | q.s. | q.s. | q.s. | q.s. | q.s. | q.s. | q.s. | q.s. | q.s. |

| | E2 | E3 | E4 | E5 | E6 | E7 | E8 | E9 | E10 | E11 | E12 |
|---|---|---|---|---|---|---|---|---|---|---|---|
| Neodox 25-6 | 7.24 | 7.24 | 7.24 | 7.24 | 7.24 | 7.24 | 7.07 | 7.07 | 7.07 | 7.07 | 7.07 |
| Neodol 25-7 | 10.00 | 10.0 | 10.0 | 10.00 | 10.0 | 10.0 | 10.0 | 10.0 | 10.0 | 10.0 | 10.0 |
| Neodol 45-7 | | | | | | | | | | | |
| BTC-8358 | | | | | | | | | | | |
| Barquat MB-50 | | | | | | | | | | | |
| Bardac LF | 7.50 | 7.50 | 7.50 | 7.50 | 7.50 | 12.5 | 7.5 | 7.5 | 7.5 | 7.5 | 7.5 |
| Steol CS-460 | | | | | | | | | | | |
| Stepanate SXS | | | | | | | | | | | |
| Blancophor TX | | | | | | | | | | | |
| Blancophor REU-170 | | | | | | | | | | | |
| Blancophor BBH | | | | | | | | | | | |
| Blancophor HRS | | | | | | | | | | | |
| Blancophor DML | | | | | | | | | | | |
| Tinopal DCS | | | | | | | | | | | |
| Leucophor BSB | | | | | | | | | | | |
| Phorwite P-150 | 1.43 | 2.14 | 2.86 | 1.40 | 1.79 | 0.90 | | | | | |
| Phorwite BBU | | | | | | | 2.50 | | | | |

TABLE 1-continued

| | | | | | | | | | | | |
|---|---|---|---|---|---|---|---|---|---|---|---|
| Phorwite UW | | | | | | | | 2.50 | | | |
| Phorwite DS | | | | | | | | | 2.22 | | |
| Phorwite BRU | | | | | | | | | | 4.00 | |
| Phorwite AR | | | | | | | | | | | 4.00 |
| sodium benzoate | | | | | | | | | | | |
| glycerine | | | | | | | | | | | |
| sodium hydroxide | 1.00 | 0.82 | 1.00 | 1.00 | 1.00 | 1.00 | 1.00 | 1.00 | 1.00 | 1.00 | 1.00 |
| Fragrance | | | | | | | | | | | |
| dye | | | | | | | | | | | |
| water | q.s. | q.s. | q.s. | q.s. | q.s. | q.s. | q.s. | q.s. | q.s. | q.s. | q.s. |

TABLE 2

| Constituent: | Tradename: | Description: |
|---|---|---|
| A | Neodox 25-6 | $C_{12-15}$-$EO_6$-$CH_2COOH$ [approx. 88.5% wt. actives] Shell Chem. Co. |
| B | BTC-8358 | alkyldimethylbenzyl ammonium chloride [80% wt. actives] Stepan Co. |
| B | Barquat MB-50 | alkyldimethylbenzyl ammonium chloride [50% wt. actives] Lonza Inc., Fairlawn NJ |
| B | Bardac LF | dioctyl dimethyl ammonium chloride [50% wt. actives] Lonza Inc., Fairlawn NJ |
| C | Neodol 45-7 | linear primary alcohol ethoxylate [100% wt. actives] Shell Chem. Co. |
| C | Neodol 25-7 | linear primary alcohol ethoxylate [100% wt. actives] Shell Chem. Co. |
| D | Tinopal DCS | stilbene based optical brightener [25% wt. actives] Ciba-Geigy |
| D | Blancophor TX | stilbene based optical brightener [13% wt. actives] Bayer |
| D | Blancophor REU-170 | stilbene based optical brightener [100% wt. actives] Bayer |
| D | Blancophor BBH | stilbene based optical brightener [100% wt. actives] Bayer |
| D | Blancophor HRS | stilbene based optical brightener [100% wt. actives] Bayer |
| D | Blancophor DML | stilbene based optical brightener [100% wt. actives] Bayer |
| D | Leucophor BSB | diaminostilbene derivative [23% wt. actives] Clariant Chemical Co. |
| D | Phorwite P-150 | stilbene disulfonic acid derivative, 4 sulfonic acid groups per molecule [28% wt. actives] Bayer |
| D | Phorwite BBU | stilbene disulfonic acid derivative, 5 sulfonic acid groups per molecule [20% wt. actives] Bayer |
| D | Phorwite UW | stilbene disulfonic acid derivative, 6 sulfonic acid groups per molecule [20% wt. actives] Bayer |
| D | Phorwite DS | stilbene disulfonic acid derivative, 2 sulfonic acid groups per molecule [20% wt. actives] Bayer |
| D | Phorwite BRU | stilbene disulfonic acid derivative, 5 sulfonic acid groups per molecule [20% wt. actives] Bayer |
| D | Phorwite AR | stilbene disulfonic acid derivative, 2 sulfonic acid groups per molecule [20% wt. actives] Bayer |
| E | Stepanate SXS | sodium xylene sulfonate [40% wt. actives] Stepan Co. |
| E | Steol CS-460 | sodium lauryl-3-ethoxy sulfate [60% wt. actives] Stepan Co. |
| — | NaOH | sodium hydroxide, aqueous [50% wt. actives] Fischer Scientific Corp. |
| | glycerine | technical grade [at least 95% wt. actives] |
| | sodium | technical grade [at least 95% wt. actives] |
| | fragrance | proprietary composition |
| | dye | proprietary composition |

"EO" represents ethoxy

In-Use Laundry Sanitization

An "in-use" laundry sanitization test was performed under conditions which simulated a domestic, viz., "in-home" laundering process, in accordance with a simulated in-use test recommended by the U.S. Environmental Protection Agency (EPA) and in the EPA Product Performance Guidelines, which is a well known test method for antimicrobial laundry additives published by Petrocci and Clarke in the Journal of the Assoc. of Official Analytical Chemists, volume 52, pages 836–842 (1969), the contents of which are herein incorporated by reference. These evaluations were performed utilizing formulations according to Examples E6 and E7, which are disclosed in detail on Table 1. In summary, inoculated fabric swatches are contacted with a test detergent dilution for 10 minutes followed by neutralization and performance of plate counts for the enumeration of survivors and calculation of the percent reduction. The percent reduction in the bacteria is calculated for the swatches and wash water separately.

In this evaluation, the formulation according to Examples E6 and E7 were tested for laundry sanitization against the test organism *Klebsiella pneumoniae,* a common gram negative pathogen, and Staph.aureus both at a use dilution of 1:500. The test was performed using three different swatches for each formulation. The results of these tests are summarized in Table 4.

TABLE 4

| | *Staph. aureus* | | *Klebsiella pneumoniae* | |
|---|---|---|---|---|
| | Swatch | Wash Water | Swatch | Wash Water |
| E6 | 99.98 | 100 | 99.99 | 100 |
| E6 | 99.98 | 100 | 99.99 | 100 |
| E6 | 99.98 | 100 | 100 | 100 |
| E7 | 100 | 100 | 100 | 100 |
| E7 | 100 | 100 | 99.99 | 100 |
| E7 | 100 | 100 | 99.99 | 100 |

The results in Table 4 clearly demonstrate the excellent sanitizing efficacy of the compositions according to the invention as demonstrated by Examples E6 and E7.

In-Use Laundry Detergency

This example demonstrates the utility of a composition of the instant invention for use as a laundry detergent. Cotton and 50/50 polyester/cotton blend fabric sample swatches were purchased from Test Fabrics (Middlesex N.J.) and Scientific Services (Oakland N.J.) The fabrics were soiled with either a standardized particulate soil, "KREFELD soil", a dust/sebum soil, an oily particulate soil, or grape juice, a stain. The soiled test fabrics were washed in a domestic washing machine using ½ cup of the liquid composition according to E6 to produce a 1:500 dilution in the wash bath (of a Sears KENMORE Model Ultra Fabric Care Heavy Duty Washing Machine (80 Series)) on a "normal" wash cycle and a "high" water setting. During this "normal" wash cycle, a warm water (105° F.) wash cycle was of 10 minutes duration, followed by cold water rinse cycle. Water hardness was 150 ppm. For comparison, a quantity of a commercially available liquid detergent, Ultra Tide® was also evaluated under the same test conditions.

For both of the tested formulations, solids removal, viz., stain removal from the various soils was assessed quantitatively using a Hunter Lab calorimeter, which measured each of the following values: the lightness ("$L_c$") of the unstained swatch; the lightness of the stained and subsequently washed swatch ("$L_w$"); redness-greenness of the unstained swatch ("$a_c$"), redness-greenness of the stained and subsequently washed swatch ("$a_w$"), yellowness-blueness of the unstained ("$b_c$") swatch, and yellowness-blueness of the stained and subsequently washed swatch ("$b_w$"); each of these values measured as the amount of the standardized white light reflected from the fabrics. The quantitatively evaluated values were measured for the various tested fabric swatches and were used to calculate the Stain Removal Index (SRI) according to the equation:

$$SRI=100-[(L_c-L_w)^2+(a_c-a_w)^2+(b_c-b_w)^2]^{1/2}$$

and the results are reported on Table 5, below. The SRI value ranges from 0 to 100, with a value of 100 indicating complete soil removal.

TABLE 5

| | SRI Values - cotton | | SRI values - poly/cotton | |
|---|---|---|---|---|
| stain type | E6 | Ultra Tide ® | E6 | Ultra Tide ® |
| Krefeld | 79.78 | 80.43 | 74.70 | 76.62 |
| dust/sebum | 81.50 | 82.1 | 77.00 | 79.42 |
| grape juice | 84.85 | 86.31 | 84.56 | 86.90 |

As can be seen from the results reported on Table 5, the reported SRI values indicate excellent detergency of the formulation according to Example 8, a representative formulation according to the instant invention, under domestic laundry conditions, even at a relatively dilute ratios of 1:500 of formulation:wash bath water.

This example demonstrates the advantages of the inventive composition in repeated washings of textiles, and the startling effects attendant upon the use of the preferred and most preferred optical brighteners in the compositions, (especially as exemplified by the composition according to E5.)

Formulations according to C1, C3, E1, E5, and Ultra Tide® were evaluated in accordance with the protocol outlined below. The composition according to C1 is also in accordance with a formulation in copending application, U.S. Ser. No. 08/666,897.

Test swatches of unbrightened, 100% cotton fabric (which had not been pretreated with any optical brightening composition or fluorescent whitening agent composition, available from Text Fabric Co. (Middlesex, N.J.) were used for the test. The whiteness of the swatches were evaluated in the test utilizing a HunterLab Colorimeter which was set up to determine the whiteness index of the swatch. The whiteness index of each swatch were first evaluated to establish a reference of "100%" for the swatch, then each sample swatch was subjected to five successive washing cycles, with each swatch being allowed to dry between each cycle. The whiteness of each swatch was evaluated on prior to any washing, and washed and dried swatches following the fifth successive washing cycle, and the whiteness index was again evaluated. The results are reported on Table 6 below, where whiteness values of less than 100% indicated a reduction in whiteness following successive washings, while whiteness values of greater than 100% indicate an increase in whiteness following successive washings.

The swatches were washed in a Tergotometer (model #7243S, available from US Testing Corp. (Hoboken, N.J.)). Washing was performed in an aqueous wash liquor in water having 150 ppm hardness at a respective 1:500 (volume) ratio of formulation to water at 105° F., at 100 rpm, for a cycle time of 10 minutes followed by a three minute clear water rinse. The evaluated whiteness index following the fifth cycle were compared to the evaluated whiteness of the unwashed swatch.. The whiteness of the swatches were evaluated and the results of these evaluations is indicated Table 6.

TABLE 6

| | % whiteness, after 5th washing |
|---|---|
| wash liquor containing C1 | 80.45% |
| wash liquor containing C3 | 83.20% |
| wash liquor containing E1 | 104.1% |
| wash liquor containing E5 | 110.39% |
| wash liquor containing Ultra Tide ® | 110.36% |

As can be seen from Table 6 the inventive compositions especially the compositions, especially those according to Ex. 5, exhibited excellent whiteness retention upon multiple washings. These results, particularly for the wash liquors containing E1 and particularly E5 were very favorable in comparison with the commercially available Ultra Tide® containing wash liquor, which commercially available product does not provide a sanitizing effect.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. An aqueous liquid laundry detergent composition having germicidal efficacy comprising:

A) 1–40 parts by weight of one or more anionic surfactant compositions selected from the group consisting of alkylethercarboxylates and alkylethersulfonates;

B) 1–25 parts by weight of one or more quaternary ammonium surfactant compositions having germicidal properties;

C) 3–50 parts by weight of one or more nonionic surfactant compositions selected from the group consisting of linear and secondary alcohol alkoxylates, alkylphenol ethoxylates, alkyl polyglycosides, amine oxides, and alkanolamides;

E) 0–10 parts by weight of one or more anionic co-surfactant compositions selected from the group consisting of alkylsulfates, alkylsulfonates, alkylethersulfates, alkylarylsulfonates, and alkylarylethersulfates present in a proportion not exceeding one half of the weight of the one or more quaternary ammonium surfactant compositions having germicidal properties;

D) 0.001–1 parts by weight of an optical brightener constituent having the following structure:

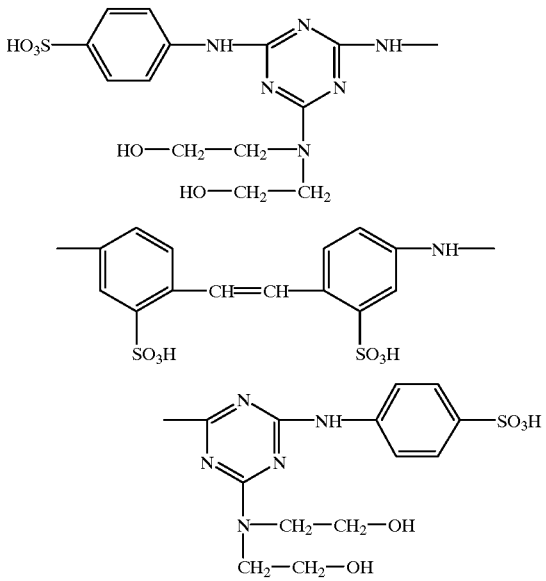

F) with the remaining balance to 100 parts by weight of water; wherein the weight ratios of B:A are at 1:2 to 2.5:2.

2. The aqueous liquid laundry detergent composition according to claim 1 wherein the one or more anionic surfactant compositions is an alkylethercarboxylate or salt thereof according to the formula:

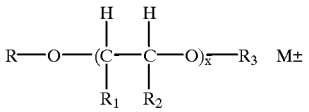

where:

R is a $C_{4-22}$ linear or branched alkyl group, x is an integer from 1 to 24, $R_1$, $R_2$ and $R_3$ is a group selected from the group consisting of: H, lower alkyl radicals including methyl radicals and ethyl radicals, carboxylate radicals including acetate and propionate radicals, succinate radicals, hydroxysuccinate radicals, or mixtures thereof wherein at least one $R_1$, $R_2$ and $R_3$ is a carboxylate, succinate or hydroxysuccinate radical; and, $M^+$ is alkali metal or ammonium counterion.

3. The aqueous liquid laundry detergent composition according to claim 2 wherein:

R is a $C_{12-15}$ linear or branched alkyl group, x is an integer from 1 to 10, $R_1$, $R_2$ and $R_3$ is a group selected from the group consisting of: H, carboxylate radicals, or mixtures thereof wherein at least one of $R_1$, $R_2$ or $R_3$ is a carboxylate radical; and, $M^+$ is sodium, potassium or ammonium counterion.

4. The liquid laundry detergent composition according to claim 3 wherein:

R is a $C_{12-15}$ linear or branched alkyl group;

x is an integer from 1 to 10;

$R_1$ and $R_2$ are hydrogen;

$R_3$ is a carboxylate radical; and, $M^+$ is sodium, potassium or ammonium counterion.

5. The liquid laundry detergent composition according to claim 1 wherein the one or more anionic surfactant compositions is an alkylethersulfonate or salt thereof according to the formula:

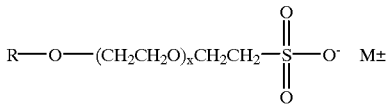

where:

R is a $C_{4-22}$ linear or branched alkyl group, x is an integer from 1 to 24, and, $M^+$ is alkali metal or ammonium counterion.

6. The liquid laundry detergent composition according to claim 5 wherein:

R is a $C_{12-15}$ linear or branched alkyl group, x is an integer from 1 to 10, and, $M^+$ is a sodium, potassium or ammonium counterion.

7. The liquid laundry detergent composition according to claim 1 wherein one or more quaternary ammonium surfactant compositions having germicidal properties is one or more quaternary ammonium compounds and salts thereof according to the formula:

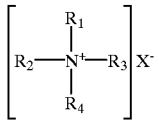

where: at least one of $R_1$, $R_2$, $R_3$ and $R_4$ is a hydrophobic, aliphatic, aryl aliphatic or aliphatic aryl radical of from 6 to 26 carbon atoms; and, the entire cation portion of the molecule has a molecular weight of at least 165.

8. The liquid laundry detergent composition according to claim 7 wherein one or more quaternary ammonium surfactant compositions having germicidal properties is one or more quaternary ammonium compounds and salts thereof according to the structural formula:

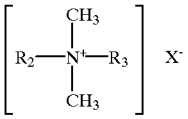

wherein:

$R_2$ and $R_3$ are selected from the group consisting of: straight chained or branched $C_8$–$C_{12}$ alkyl radicals, or $R_2$ is a group selected from the group consisting of: straight chained or branched $C_{12-16}$ alkyl, $C_{8-18}$ alkylethoxy, $C_{8-18}$ alkylphenolethoxy radicals and $R_3$ is benzyl; and, X is a halide, or methosulfate.

9. The liquid laundry detergent composition according to claim 1 wherein the anionic co-surfactant is an alkylether sulfate or salt thereof according to the formula:

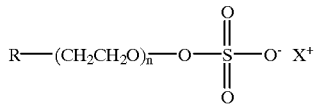

where:

R is a $C_8$–$C_{18}$ alkyl group;

n is an integer from 1 to 30; and,

X represents an counterion selected from the group consisting of: alkaline earth metals and ammonium.

10. Aqueous liquid laundry detergent compositions having germicidal efficacy according to claim 1 further comprising:

0 to 10 parts by weight based on the total weight of the aqueous detergent composition of one or more additives selected from the group consisting of: builders, chelating agents, pH adjusters, stabilizers, hydrotropes, rheology modifying agents, sequestrants, solvents, coloring agents, and fragrances.

11. The aqueous liquid laundry detergent compositions having germicidal efficacy according to claim 1 comprising:

A) 5–30 parts by weight of one or more anionic surfactant compositions selected from the group consisting of: alkylethercarboxylates and alkylethersulfonates;

B) 5–20 parts by weight of one or more quaternary ammonium surfactant compositions having germicidal properties;

C) 5–30 parts by weight of one or more nonionic surfactant compositions selected from the group consisting of: linear and secondary alcohol alkoxylates, alkylphenol ethoxylates, alkyl polyglycosides, amine oxides, and alkanolamides;

E) 1–8 parts by weight of one or more anionic co-surfactant compositions selected from the group consisting of: alkylsulfates, alkylsulfonates, alkylethersulfates, alkylarylsulfonates, and alkylarylethersulfates present in a proportion not exceeding one half of the weight of the one or more quaternary ammonium surfactant compositions having germicidal properties;

D) 0.001–1 parts by weight of a optical brightener constituent according to the structure:

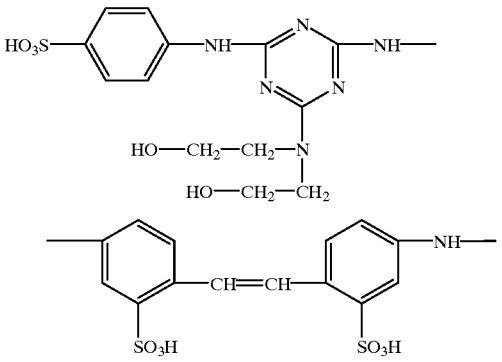

-continued

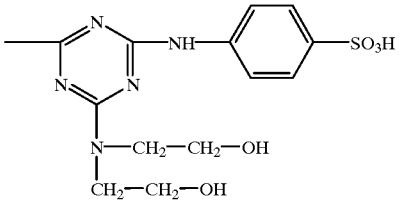

F) with the remaining balance to 100 parts by weight of water; wherein the weight ratios of B:A are at 1:2 or greater.

12. Aqueous liquid laundry detergent compositions having germicidal efficacy according to claim 11 wherein the weight ratios of B:A are at least 1.5:2.

13. Aqueous liquid laundry detergent compositions having germicidal efficacy according to claim 11 comprising:

A) 10–20 parts by weight of one or more anionic surfactant compositions selected from the group consisting of: alkylethercarboxylates and alkylethersulfonates;

B) 6–12 parts by weight of one or more quaternary ammonium surfactant compositions having germicidal properties;

C) 10–25 parts by weight of one or more nonionic surfactant compositions selected from the group consisting of linear and secondary alcohol alkoxylates, alkylphenol ethoxylates, alkyl polyglycosides, amine oxides, and alkanolamides;

E) 2–5 parts by weight of one or more anionic co-surfactant compositions selected from the group consisting of: alkylsulfates, alkylsulfonates, alkylethersulfates, alkylarylsulfonates, and alkylarylethersulfates present in a proportion not exceeding one half of the weight of the one or more quaternary ammonium surfactant compositions having germicidal properties;

D) 0.001–1 parts by weight of a optical brightener constituent having the structure:

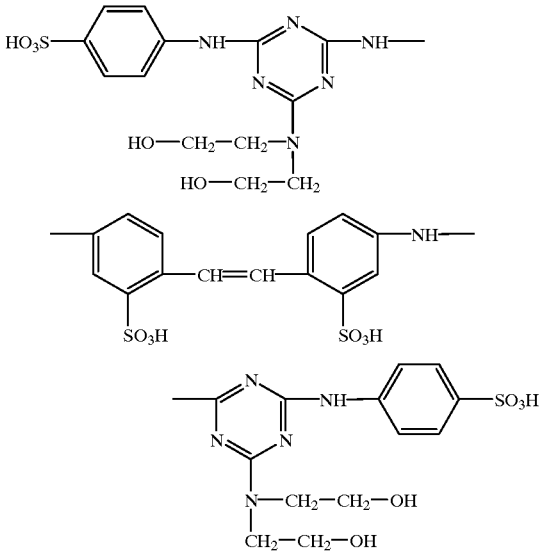

F) with the remaining balance to 100 parts by weight of water; wherein the weight ratios of B:A are at 1:2 or greater.

14. Aqueous liquid laundry detergent compositions having germicidal efficacy according to claim 11 wherein the weight ratios of B:A are at least 1.5:2.

15. An aqueous liquid laundry detergent composition according to claim 1 which comprises:

A) 1–40 parts by weight of an alkylethersulfonate;

B) 1–25 parts by weight of one or more quaternary ammonium surfactant compositions having germicidal properties;

C) 3–50 parts by weight of one or more nonionic surfactant compositions selected from the group consisting of: linear and secondary alcohol alkoxylates, alkylphenol ethoxylates, alkyl polyglycosides, amine oxides, and alkanolamides;

E) 0–10 parts by weight of one or more anionic co-surfactant compositions selected from the group consisting of: alkylsulfates, alkylsulfonates, alkylethersulfates, alkylarylsulfonates, and alkylarylethersulfates present in a proportion not exceeding one half of the weight of the one or more quaternary ammonium surfactant compositions having germicidal properties;

D) 0.001–1 parts by weight of an optical brightener constituent having the structure:

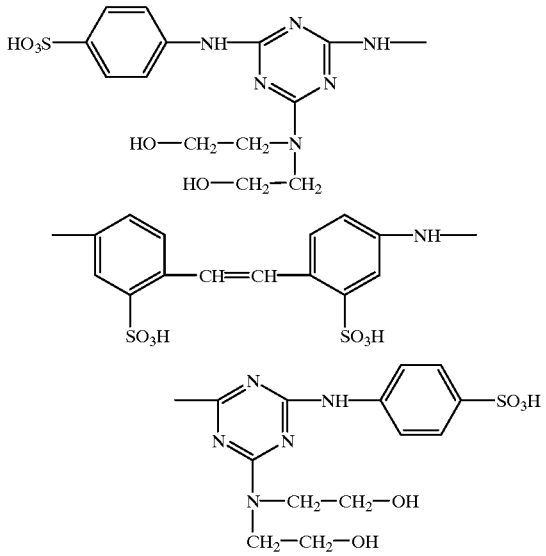

F) with the remaining balance to 100 parts by weight of water; wherein the weight ratios of B:A are at 1:2 or greater.

16. A process for the simultaneous laundering and sanitization of textile fabrics comprising the process step of:

laundering said textile fabrics in an aqueous wash bath which contains an aqueous liquid laundry detergent composition having germicidal efficacy which comprises:

A) 1–40 parts by weight of one or more anionic surfactant compositions selected from the group consisting of: alkylethercarboxylates and alkylethersulfonates;

B) 1–25 parts by weight of one or more quaternary ammonium surfactant compositions having germicidal properties;

C) 3–50 parts by weight of one or more nonionic surfactant compositions selected from the group consisting of: linear and secondary alcohol alkoxylates, alkylphenol ethoxylates, alkyl polyglycosides, amine oxides, and alkanolamides;

E) 0–10 parts by weight of one or more anionic co-surfactant compositions selected from the group consisting of: alkylsulfates, alkylsulfonates, alkylethersulfates, alkylarylsulfonates, and alkylarylethersulfates present in a proportion not exceeding one half of the weight of the one or more quaternary ammonium surfactant compositions having germicidal properties;

D) 0.001–1 parts by weight of an optical brightener constituent having the structure:

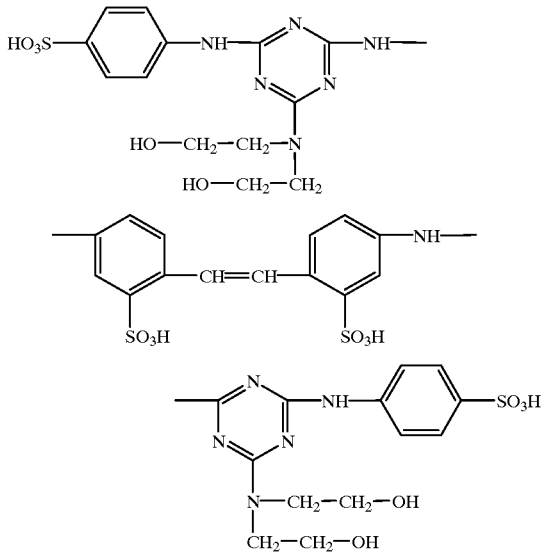

F) with the remaining balance to 100 parts by weight of water; wherein the weight ratios of B:A are at 1:2 to 2.5:2.

17. The process according to claim 16 wherein the liquid laundry detergent compositions are present in the aqueous bath in a weight ratio of detergent composition:water of at least 1:500.

18. The process according to claim 17 wherein the liquid laundry detergent compositions are present in the aqueous bath in a weight ratio of detergent composition:water of from 1:500–1:330.

19. A process according to claim 16 for the simultaneous laundering and sanitization of textile fabrics comprising the process step of: laundering said textile fabrics in an aqueous wash bath which contains an aqueous liquid laundry detergent composition having germicidal efficacy which comprises:

A) 5–30 parts by weight of one or more anionic surfactant compositions selected from the group consisting of: alkylethercarboxylates and alkylethersulfonates;

B) 5–20 parts by weight of one or more quaternary ammonium surfactant compositions having germicidal properties;

C) 5–30 parts by weight of one or more nonionic surfactant compositions selected from the group consisting of: linear and secondary alcohol alkoxylates, alkylphenol ethoxylates, alkyl polyglycosides, amine oxides, and alkanolamides;

D) 0.001–1 parts by weight of an optical brightener constituent having the structure:

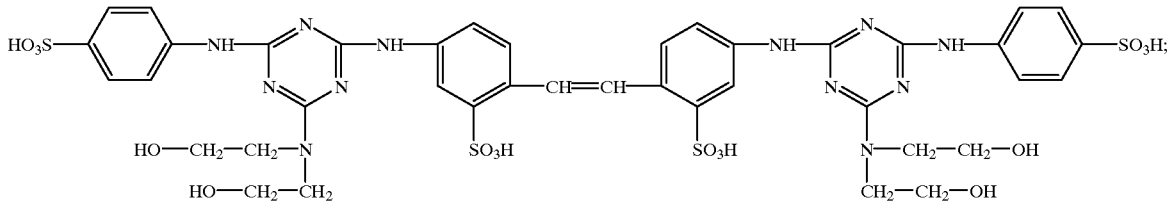

E) 1–8 parts by weight of one or more anionic co-surfactant compositions selected from the group consisting of: alkylsulfates, alkylsulfonates, alkylethersulfates, alkylarylsulfonates, and alkylarylethersulfates present in a proportion not exceeding one half of the weight of the one or more quaternary ammonium surfactant compositions having germicidal properties;

F) with the remaining balance to 100 parts by weight of water; wherein the weight ratios of B:A are at 1:2 or greater.

20. The process according to claim 19 wherein the liquid laundry detergent compositions are present in the aqueous bath in a weight ratio of detergent composition:water of from 1:500–1:330.

* * * * *